United States Patent [19]

Zierhut

[11] Patent Number: 5,007,754

[45] Date of Patent: Apr. 16, 1991

[54] SHOE POLISH APPLICATOR

[75] Inventor: Clarence D. Zierhut, Richardson, Tex.

[73] Assignee: King Imports, Inc., San Antonio, Tex.

[21] Appl. No.: 309,376

[22] Filed: Feb. 13, 1989

[51] Int. Cl.[5] ..... A46B 11/02

[52] U.S. Cl. ..... 401/174; 401/269; 401/288

[58] Field of Search ..... 401/269, 175, 174, 172, 401/171, 288

[56] References Cited

U.S. PATENT DOCUMENTS

| | | | |
|---|---|---|---|
| 193,308 | 7/1877 | Worthington | 401/175 |
| 815,934 | 3/1906 | Rogers | 401/175 |
| 1,049,863 | 1/1913 | Happle et al. | 401/269 X |
| 1,179,338 | 4/1916 | Savage | 401/175 |
| 1,218,393 | 3/1917 | Gensmer | 401/175 |
| 1,225,502 | 5/1917 | Russel | 401/175 |
| 1,342,537 | 6/1920 | Everett | 401/175 |
| 1,458,281 | 6/1923 | Everett | 401/175 |
| 1,701,663 | 2/1929 | Clark | 401/175 |
| 1,890,319 | 12/1932 | Echstein | 401/175 |
| 1,936,261 | 11/1933 | Pierson et al. | 401/175 X |
| 2,146,847 | 2/1939 | Poole et al. | 401/175 X |
| 3,008,172 | 11/1961 | Thompson | 401/175 |

FOREIGN PATENT DOCUMENTS

| | | | |
|---|---|---|---|
| 264824 | 4/1988 | European Pat. Off. | 401/269 |
| 3312392 | 10/1983 | Fed. Rep. of Germany | 401/175 |
| 907679 | 7/1945 | France | 401/269 |
| 595911 | 7/1959 | Italy | 401/175 |
| 603327 | 3/1960 | Italy | 401/175 |
| 643983 | 8/1962 | Italy | 401/175 |
| 205125 | 8/1939 | Switzerland | 401/175 |
| 895257 | 5/1962 | United Kingdom | 401/269 |

*Primary Examiner*—Steven A. Bratlie
*Attorney, Agent, or Firm*—Daniel V. Thompson

[57] ABSTRACT

A shoe polish applicator includes a hollow body having a plurality of internal walls defining a reservoir for shoe polish. The internal walls include a rearward internal sidewall having elliptical cross-sections about a rearward axis and a forward internal sidewall having circular cross-sections about a forward axis. The rearward and forward internal sidewalls are joined at a shoulder.

1 Claim, 3 Drawing Sheets

SHOE POLISH APPLICATOR

TECHNICAL FIELD

This invention relates to shoe polish applicators, and more particularly to an applicator apparatus having an aperture through which shoe polish is extruded.

BACKGROUND ART

Paste shoe polish has long been applied to leather goods, such as shoes, by means of rags, brushes or fingertips dipped into an open can or container of paste wax. This prior art method of application is messy and requires that rags and brushes contaminated with polish be stored or otherwise disposed of. Staining of the hands is a problem where the polish is applied by hand, whereas a brush used to apply repeated coatings of polish becomes progressively more stiff as the polish dries, and no convenient means has yet been devised by which such a brush may be cleaned between uses. The conventional technique of polish application causes inefficient use and even wastage of polish, due to the evaporation of solvents from the wax during repeated openings of the wax container.

SUMMARY OF THE INVENTION

The present invention provides a shoe polish applicator having a hollow body defining a reservoir for shoe polish. A rearward internal sidewall of the body has elliptical cross-sections about a rearward axis, whereas a forward internal sidewall has circular cross-sections about a forward axis. The rearward and forward internal sidewalls are joined at a shoulder, with the rearward and forward axes preferably intersecting at an obtuse included angle. A planar forward internal end wall includes an aperture through which shoe polish is extruded and holds a number of brush filament groups. A plunger inside the hollow body cooperates with a mechanism for translating the plunger to cause shoe polish extrusion. A cap for the surface about the opening from which the brush filaments extend includes a stopper for sealing the opening when the cap is fixed to the hollow body.

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION OF THE PREFERRED EMBODIMENT

Figure 1:
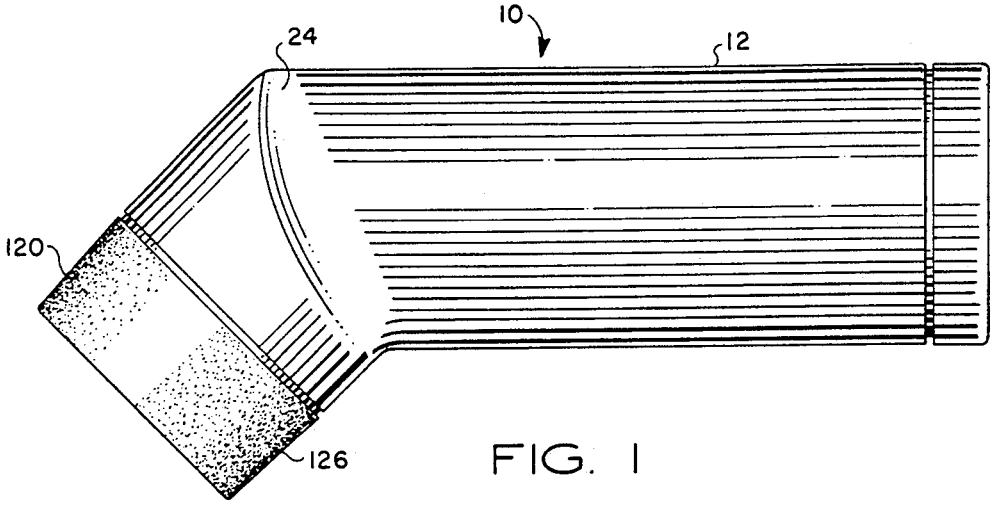
FIG. 1 is a side view of a shoe polish applicator constructed in accordance with the invention.

Referring initially to FIGS. 1-8, where like numerals refer to like and corresponding elements, a shoe polish applicator 10 includes a hollow body 12 having a plurality of internal walls defining a reservoir for shoe polish 14. Specifically, hollow body 12 includes a rearward internal sidewall 16 having elliptical cross-sections about a rearward axis 18. A forward internal sidewall 20 has circular cross-sections about a forward axis 22.

Figure 2:
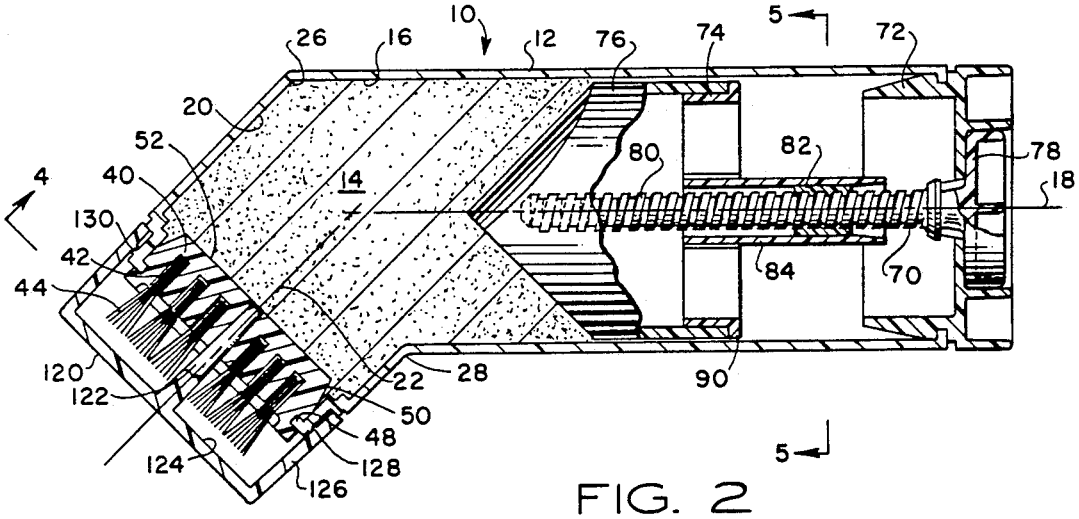
FIG. 2 is a partially broken away side view of the shoe polish applicator of FIG. 1.
Figure 5:
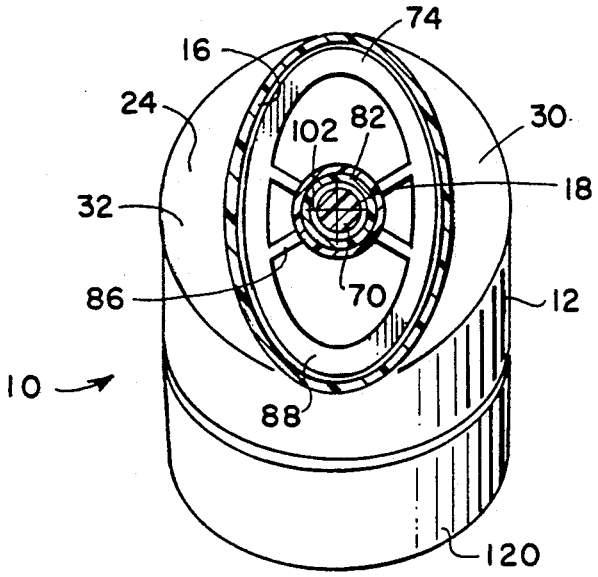
FIG. 5 is a sectional view taken along lines 5—5 of FIG. 2.

As best shown in FIG. 2, the largest cross-sectional dimension of elliptical rearward internal sidewall 16 is equal to the diameter of cylindrical forward internal sidewall 20. Thus, there is a smooth transition directly between the forward and rearward internal sidewalls at upper shoulder portion 26 and lower shoulder portion 28. The transition between the smaller cross-sectional dimensioned portions of the elliptical sidewall, as best shown in FIG. 5, is provided by lateral shoulder portions 30 and 32.

Preferably, forward axis 22 and rearward axis intersect at an obtuse included angle, as best shown in FIG. 2. In the preferred embodiment, the included angle between the axes is 135 degrees.

Figure 6:
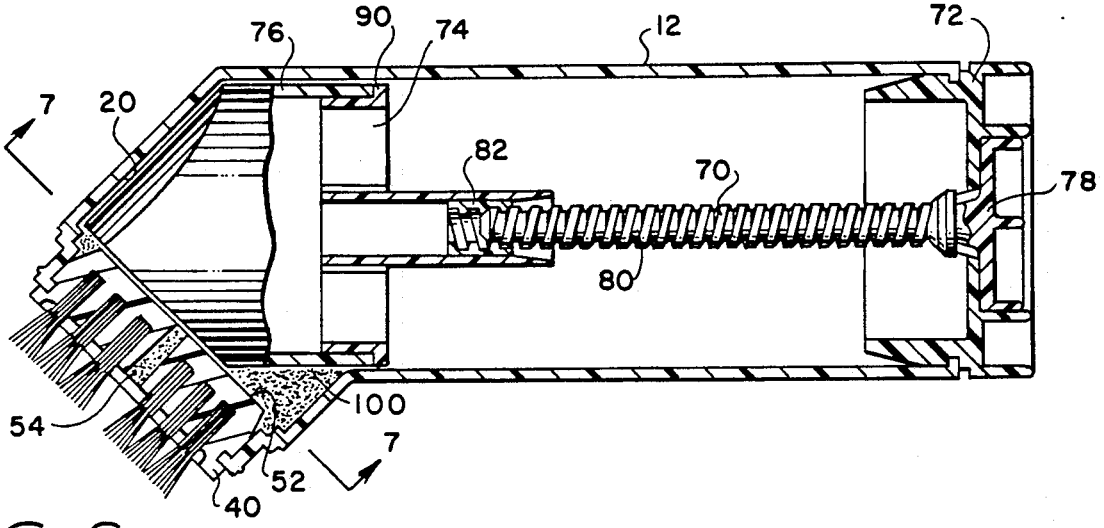
FIG. 6 is a partially broken away side view similar to FIG. 2 with the plunger advanced to the forwardmost end of the hollow body.

A brush retainer 40 is connected to hollow body 12 at its extreme forward end. Brush retainer 40 includes a plurality of pockets 42 for holding discrete groups of brush filaments 44. A circumferential groove 46 is provided for engagement with inwardly-facing lip 48 of hollow body 12. A tapered portion 50 enables brush retainer 40 to be snap-fitted into engagement with hollow body 12. Brush retainer 40 also includes a planar forward internal end wall 52 perpendicular to forward axis 22. As best shown in FIG. 6, tapered walls 54 form an aperture in brush retainer 40 coaxial with forward axis 22.

The shoe polish applicator includes a means for extruding shoe polish 14 through the aperture formed by walls 54. The means for extruding includes a knob and screw assembly 70, a tail cap 72, a plunger driver 74 and plunger 76. Tail cap assembly 70 includes a knob 78 and a left-hand threaded screw portion 80. Plunger driver 74 includes a threaded insert 82 engaged with threaded portion 80. Insert 82 is fixed to a tubular body portion 84, which inturn is connected by way of webs 86 to an elliptical band member 88. An elliptical lip 90 extends outwardly from band member 88 for engagement with a rearward edge 92 on plunger 76.

Figure 3:
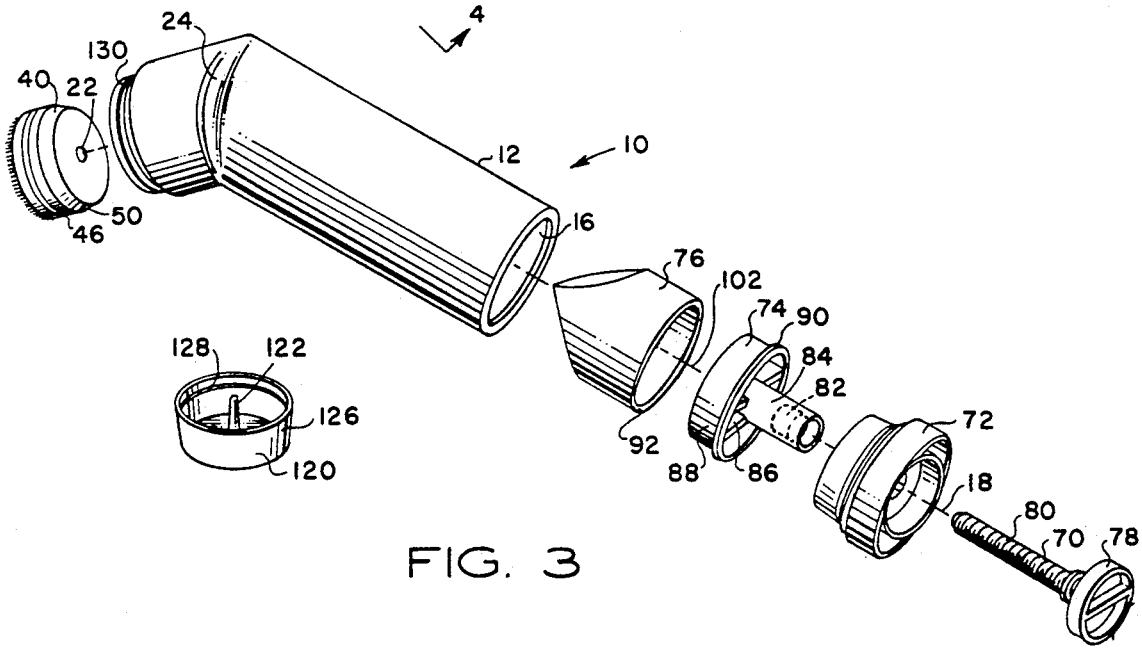
FIG. 3 is an exploded view of the shoe polish applicator.
Figure 4:
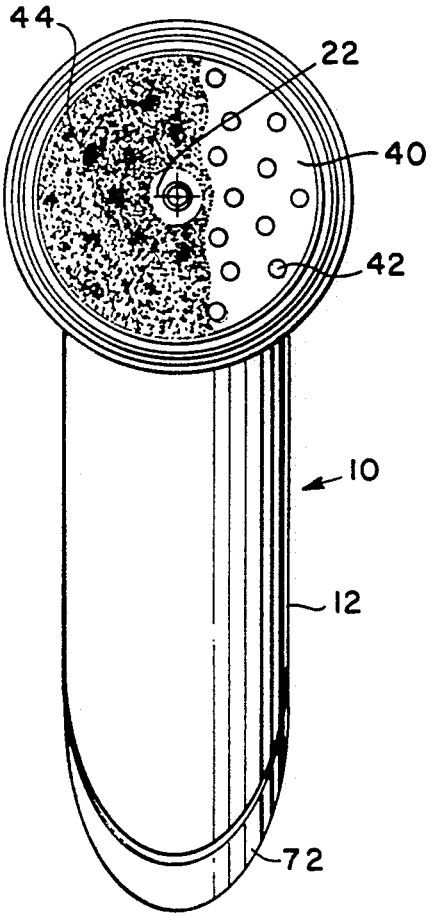
FIG. 4 is a sectional view taken along lines 4—4 of FIG. 2.
Figure 9:
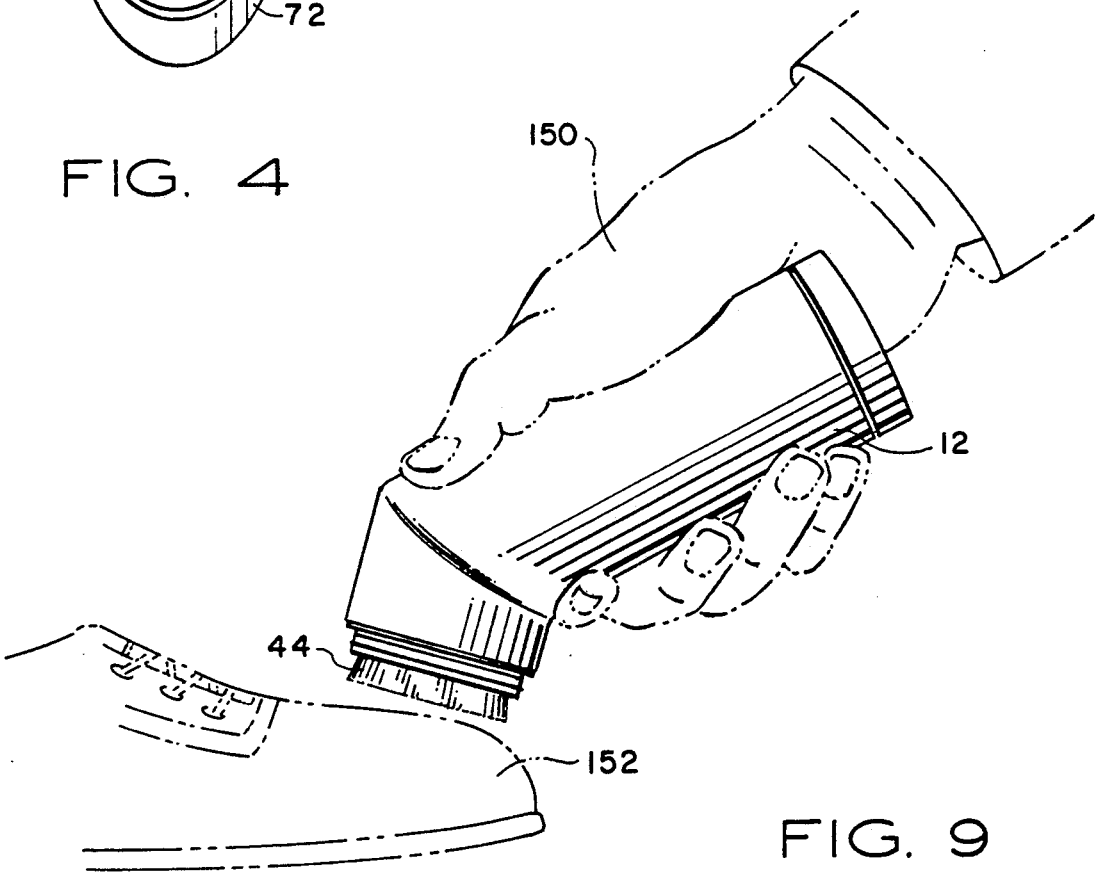
FIG. 9 is a schematic view illustrating the use of the shoe polish applicator.
Figure 8:
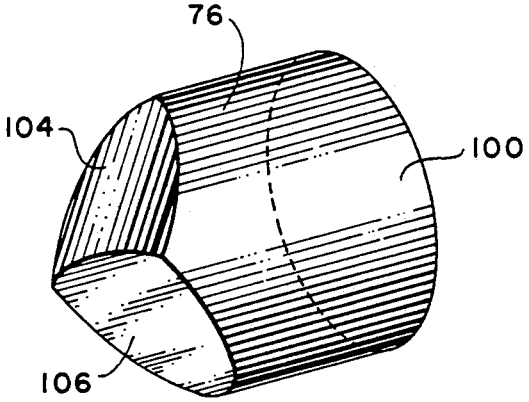
FIG. 8 is a perspective view of the plunger used in the invention.

Plunger 76 is specially formed to enable efficient extrusion of shoe polish from hollow body 12. Hollow body 12, with its elliptical and cylindrical internal sidewalls, is most efficiently utilized with the specially shaped plunger as shown in order to minimize the amount of unextrudable shoe polish. As best shown in FIGS. 8 and 9, plunger 76 includes an elliptical external sidewall 100. Sidewall 100 is elliptical about plunger axis 102, which, as shown in FIGS. 3 and 5, is coaxial with rearward axis 18 of the hollow body 12. Elliptical external sidewall 100 is joined to a first external front wall 104 that is partially cylindrical about forward axis 18. Plunger 76 also includes a second external front wall 106 which is planar and parallel to forward end wall 52 of retainer 40.

Figure 7:
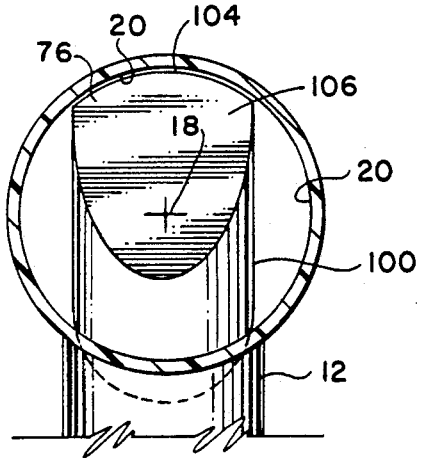
FIG. 7 is a sectional view taken along lines 7—7 of FIG. 6.

The dimensions of elliptical external sidewall 100 are chosen such that it closely interfits with the internal sidewall 16 of the hollow body 12. The radius of first front wall 104 is selected such that first external front wall 104 is closely spaced to a portion of forward internal sidewall 20 when plunger 76 is advanced to its forwardmost position, as shown in FIG. 7. As best shown in FIG. 7, planar second external front wall 106 is closely spaced to forward internal end wall 52 when plunger 76 is translated to its forwardmost position.

The shoe polish applicator also includes a cap 120 having a stopper 122 extending from internal surface 124. Stopper 122 is integral with cap 120, which preferably is molded from a resilient plastic material. Preferably, surface 124 is planar and has a circular perimeter from which a tubular sidewall 126 extends. Tubular sidewall 126 includes a lip 128 on the internal surface thereof, which engages a similar lip 130 formed on the extreme forward end of hollow body 12. Stopper 122 has outer walls which are tapered to closely interfit with walls 54 in brush retainer 40. When cap 120 is snap fitted to the end of hollow body 12, stopper 122 substantially air-tightly seals the aperture formed by walls 54.

In operation, as shown in FIG. 9, cap 120 is removed thereby extracting stopper 122 from the aperture formed by walls 54 and uncovering brush filaments 44. Knob and screw assembly 70 is then rotated in a clockwise direction by way of application of torque to knob portion 78. Plunger driver 74 is then driven in a forward direction by way of the left hand threaded relationship between insert 82 and threaded portion 80. Plunger 76 is thereby driven forwardly, compressing shoe polish 14 and extruding a quantity from the aperture formed by walls 54. Body 12 is then firmly gripped by the user's hand 150 and moved in relation to and in contact with shoe 152 to evenly apply shoe polish. As required, knob 78 is further rotated to extrude additional quantities of polish.

Whereas the present invention has been described with respect to a specific embodiment thereof, it will be understood that various changes and modifications will be suggested to one skilled in the art and it is intended to encompass such changes and modifications as fall within the scope of the appended claims.

I claim:

1. A shoe polish applicator, comprising:

a hollow body having a plurality of internal walls defining a reservoir for shoe polish, said internal walls comprising a rearward internal side wall having elliptical cross-sections about a rearward axis and a forward internal side wall having circular cross-sections about a forward axis, said rearward and forward internal side walls being joined at a shoulder;

said rearward and forward axes intersecting at an obtuse included angle;

a planar forward internal end wall of said body joined to said forward internal side wall and being perpendicular to said forward axis;

extruder means for extruding said shoe polish from an opening in said forward internal end wall;

said extruder means including a plunger constrained for movement within said body and translation means for translating said plunger within said body;

said plunger including an external side wall elliptical about a plunger axis coaxial with said rearward axis of said body and spaced closely with said rearward internal side wall, a first external front wall partially cylindrical about said forward axis of said body and joined to said plunger side wall, and a second external front wall being planar and parallel to said forward end wall, said first and second external front walls being closely spaced to said forward internal side and end walls, respectively, when said plunger is translated to a forward-most position by way of said means for translation;

brushes extending from a surface about said opening in said forward internal end wall, said forward internal end wall being planar and having a circular perimeter, with said opening being centrally located in said forward internal end wall; and a removable cap for covering said opening and brushes fixed to the hollow body, said cap including a stopper integral with the cap and extending from an internal surface thereof to seal the opening when the cap is fixed to the hollow body.

* * * * *